US011352780B2

(12) United States Patent
Foster

(10) Patent No.: US 11,352,780 B2
(45) Date of Patent: Jun. 7, 2022

(54) AUTOCLAVE AERATED CONCRETE STRUCTURES WITH EMBEDDED HANGERS AND CONNECTORS

(71) Applicant: Thermacrete LLC, Lake Bluff, IL (US)

(72) Inventor: Matthew Foster, Lake Bluff, IL (US)

(73) Assignee: Thermacrete LLC, Lake Bluff, IL (US)

( * ) Notice: Subject to any disclaimer, the term of this patent is extended or adjusted under 35 U.S.C. 154(b) by 139 days.

(21) Appl. No.: 16/405,459

(22) Filed: May 7, 2019

(65) Prior Publication Data

US 2020/0354952 A1 Nov. 12, 2020

(51) Int. Cl.

| | |
|---|---|
| ***E04B 1/41*** | (2006.01) |
| ***E04C 2/04*** | (2006.01) |
| ***E04C 2/00*** | (2006.01) |
| ***E04C 2/06*** | (2006.01) |

(52) U.S. Cl.

CPC ..... *E04B 1/4157* (2013.01); *E04C 2/044* (2013.01); *E04C 2/049* (2013.01); *E04C 2/06* (2013.01); *E04B 2103/02* (2013.01); *E04C 2002/001* (2013.01); *E04C 2002/002* (2013.01)

(58) Field of Classification Search

CPC ..... E04B 1/4157; E04B 2103/02; E04C 2/00; E04C 2/044; E04C 2/049; E04C 2/288; E04C 2/06; E04C 2002/001; E04C 2002/002

See application file for complete search history.

(56) References Cited

U.S. PATENT DOCUMENTS

| | | | | |
|---|---|---|---|---|
| 1,075,252 A * | 10/1913 | Graham | E04B 5/43 52/252 |
| 1,935,574 A | 11/1933 | Munroe et al. | |
| 3,300,931 A | 1/1967 | Lutze | |
| 3,363,371 A | 1/1968 | Villalobos | |
| 3,468,094 A * | 9/1969 | Campbell | E04B 1/35 52/745.02 |
| 3,558,005 A | 1/1971 | Crabtree et al. | |
| 3,611,653 A | 10/1971 | Zinn | |
| 3,774,359 A * | 11/1973 | Kahn | E04C 2/384 52/125.4 |

(Continued)

FOREIGN PATENT DOCUMENTS

| | | |
|---|---|---|
| AU | 2005277009 B2 | 3/2006 |
| CA | 2575061 C | 10/2012 |

(Continued)

OTHER PUBLICATIONS

Schnitzler, Stephan, "Sustainability and the Built Environment UC Davis Extension," Applied Research Paper: Autoclaved Aerated Concrete as a Green Building Material, Oct. 2006, 6 pages.

(Continued)

*Primary Examiner* — Jessie T Fonseca

(74) *Attorney, Agent, or Firm* — Bishop, Diehl & Lee, Ltd.

(57) ABSTRACT

The present invention pertains to an element of an autoclave aerated concrete (AAC) material having a web of a second material different from AAC embedded therein and generally centrally disposed in a depth dimension of the element and between two planar faces and the second material supporting hardware for connecting the element to other structures.

13 Claims, 6 Drawing Sheets

(56) References Cited

U.S. PATENT DOCUMENTS

| | | | | |
|---|---|---|---|---|
| 3,837,984 | A | 9/1974 | Wagner et al. | |
| 3,852,931 | A | 12/1974 | Morse et al. | |
| 3,885,362 | A | 5/1975 | Pollock | |
| 3,913,290 | A | 10/1975 | Billing et al. | |
| 4,185,437 | A | 1/1980 | Robinson | |
| 4,186,714 | A | 2/1980 | Danckert et al. | |
| 4,215,664 | A | 8/1980 | Hatz | |
| 4,295,691 | A | 10/1981 | Rubenthaler | |
| 4,371,858 | A | 2/1983 | Kanoi et al. | |
| 4,453,359 | A | 6/1984 | Robinson | |
| 4,531,338 | A | 7/1985 | Donatt | |
| 4,605,090 | A | 8/1986 | Melfi | |
| 4,641,468 | A | 2/1987 | Slater | |
| 4,674,253 | A | 6/1987 | Young | |
| 4,702,046 | A | 10/1987 | Haugen et al. | |
| 5,332,191 | A * | 7/1994 | Nolan | B28B 7/0073 249/1 |
| 5,335,893 | A | 8/1994 | Opp | |
| 5,426,908 | A | 6/1995 | Shayman | |
| 5,460,348 | A | 10/1995 | Cox | |
| 5,526,629 | A | 6/1996 | Cavaness | |
| 5,661,273 | A | 8/1997 | Bergiadis | |
| 5,907,932 | A | 6/1999 | Leconte et al. | |
| 5,950,277 | A | 9/1999 | Tallmadge et al. | |
| 5,953,883 | A | 9/1999 | Ojala | |
| 6,266,936 | B1 | 7/2001 | Gelin | |
| 6,421,973 | B1 | 7/2002 | Gregg et al. | |
| 6,460,301 | B1 | 10/2002 | Mckee | |
| 6,494,008 | B1 * | 12/2002 | Bloem | E01F 8/0017 181/210 |
| 6,729,094 | B1 * | 5/2004 | Spencer | E04B 5/10 52/334 |
| 7,398,856 | B2 | 7/2008 | Foster et al. | |
| 7,946,384 | B2 | 5/2011 | Foster et al. | |
| 8,235,350 | B2 | 8/2012 | Testuda et al. | |
| 8,424,263 | B2 * | 4/2013 | Hsieh | E04B 5/04 52/414 |
| 9,140,017 | B1 | 9/2015 | Oliver | |
| 9,145,679 | B2 * | 9/2015 | Ahern | E04C 2/38 |
| 2001/0010140 | A1 | 8/2001 | Ritter et al. | |
| 2002/0092703 | A1 | 7/2002 | Gelin et al. | |
| 2003/0070367 | A1 | 4/2003 | Gelin et al. | |
| 2003/0192279 | A1 | 10/2003 | Hughart | |
| 2004/0098934 | A1 * | 5/2004 | Lawson | E04C 2/049 52/270 |
| 2005/0016104 | A1 | 1/2005 | Seccombe | |
| 2005/0188626 | A1 | 9/2005 | Johnson | |
| 2006/0042874 | A1 | 3/2006 | Foster et al. | |
| 2006/0048997 | A1 | 3/2006 | Foster et al. | |
| 2007/0125017 | A1 * | 6/2007 | Blount | E04F 13/0835 52/223.1 |
| 2008/0184643 | A1 | 8/2008 | Foster et al. | |
| 2009/0282759 | A1 | 11/2009 | Porter | |
| 2013/0255178 | A1 | 10/2013 | Judd | |
| 2014/0209270 | A1 * | 7/2014 | Imbabi | F24D 3/141 165/56 |
| 2014/0305046 | A1 | 10/2014 | Stearns et al. | |
| 2014/0306088 | A1 * | 10/2014 | Dryburgh | E04C 2/06 249/13 |
| 2017/0166001 | A1 * | 6/2017 | Shaw | B44F 9/02 |
| 2017/0298626 | A1 * | 10/2017 | Shaw | C04B 41/72 |
| 2019/0184602 | A1 * | 6/2019 | Liu | E04C 2/049 |

FOREIGN PATENT DOCUMENTS

| | | | | |
|---|---|---|---|---|
| CA | 2994868 | A1 * | 4/2018 | E04C 2/288 |
| CN | 108978983 | A | 12/2018 | |
| GB | 190617654 | A * | 12/1906 | |
| JP | 04124072 | A * | 4/1992 | |
| JP | 6058470 | B2 * | 1/2017 | |
| MX | 315769 | | 11/2013 | |
| NZ | 553901 | A | 12/2010 | |
| WO | 2006023999 | A2 | 3/2006 | |
| WO | 2006023999 | A3 | 3/2006 | |
| WO | 2008097102 | A1 | 8/2008 | |
| WO | 2017011858 | A1 | 1/2017 | |

OTHER PUBLICATIONS

European Patent Office; Extended European Search Report for European Application No. 20173512.3; dated Oct. 2, 2020; 7 pages.

* cited by examiner 10
12
14
74
76
80
100
110
112
114

AUTOCLAVE AERATED CONCRETE STRUCTURES WITH EMBEDDED HANGERS AND CONNECTORS

CROSS-REFERENCE TO RELATED APPLICATION

N/A

FEDERALLY SPONSORED RESEARCH OR DEVELOPMENT

N/A

BACKGROUND OF THE INVENTION

Technical Field

The present invention pertains to autoclave aerated concrete (AAC) elements with embedded hardware for connecting, suspending and use in construction; and more particularly to AAC panels with embedded hangers and connectors.

Background

AAC is typically formed as a blend of sand or fly ash, lime, Portland cement, water, and an expansion agent of aluminum powder or paste. The mixture is usually cast into large molds and allowed to expand to a volume greater than the original semi-fluid mass. The processed elements are then placed into large pressurized chambers called autoclaves to complete the curing or hardening of the finished product. The structural elements are typically cured for 8-12 hours at 12-13 atmospheric pressures at 360-385 degrees Fahrenheit. The elements are cut to size either prior to or after autoclaving.

AAC is lightweight compared to normal concrete. For example, typical AAC weighs one-fourth to one-fifth the weight of normal concrete, which weighs in the range 130 to 145 lbs/ft. AAC has extreme thermal properties. It displays no spalling of material when exposed to temperatures at or approaching 2000 degrees Fahrenheit. AAC is an inorganic material resistant to weather decay and pest attack. AAC also provides significant acoustical barrier properties. Suitable AAC materials are sold by THERMACRETE the assignee of the present invention. Another material aerated concrete (AC) is also available for purchase in the form of panels, for example. Unlike AAC, AC is allowed to air cure in normal single atmospheric pressures and ambient temperatures. The process for achieving maximum strength takes longer than AAC. Typical curing time for AC is 7-28 days versus 20-24 hours for AAC. Aerated concrete is sold under the trade names FLEXCRETE, PEARLITE, DUR-ROCK and HARDIE BOARD.

SUMMARY OF THE INVENTION

The present invention provides an autoclave aerated concrete (AAC) element having a web of material of a second material, different from AAC, embedded therein and supporting hardware for connecting the AAC element to other structures.

The present invention also provides a method for forming a plurality of autoclave aerated concrete panels using the steps of: (1) providing a mold for forming the plurality of the aerated concrete panels; (2) inserting into the mold a plurality of webs of material supporting a member for connecting to another structure, one web of material for each of the plurality of aerated concrete panels and positioned in parallel spaced relationship and spaced from one another; (3) adding into the mold a first set of ingredients; (4) adding into the mold an expansion agent for reacting with one or more of the first set of ingredients to generate a gas to expand the volume of first set of ingredients to form the concrete into a solid block; (5) removing the solid block from the mold; (6) cutting the block between each pair of adjacent panels to form a plurality of uncured, green panels; and (7) placing the green panels in an autoclave and heating at an elevated temperature and an elevated pressure for an effective period of time to form the plurality of AAC panels. Step 6 of cutting the block can also occur after step 7 of autoclaving.

A method for installing an autoclave aerated concrete (AAC) panel on to a structure including the steps of: (1) providing an autoclave aerated concrete panel having a web of material of a second material different from AAC embedded therein and supporting hardware for connecting the AAC panel to other structures; (2) positioning the AAC panel into engagement with the structure; and (3) connecting a portion of the structure to the hardware with a fastener to secure the AAC panel to the structure.

DETAILED DESCRIPTION OF THE INVENTION

The present invention is susceptible to embodiments in many different forms. Preferred embodiments of the invention are disclosed with the understanding that the present disclosure is to be considered as exemplifications of the principles of the invention and are not intended to limit the broad aspects of the invention to the embodiments illustrated.

Autoclave aerated concrete (AAC) can take on numerous structural forms for use in construction in load and non-load bearing forms such as panels, cladding, beams, lintels, and blocks. Due to AAC's design flexibility and combined structural and insulation components, an entire structure can be built using the one material. Exterior surfaces can be finished with stucco, traditional veneers or siding, while interior walls can be plastered, painted, or left unfinished, in addition to traditional sheetrock finishes. Further, AAC is easy to use and can be cut and manipulated with normal wood-working tools.

Figure 1:
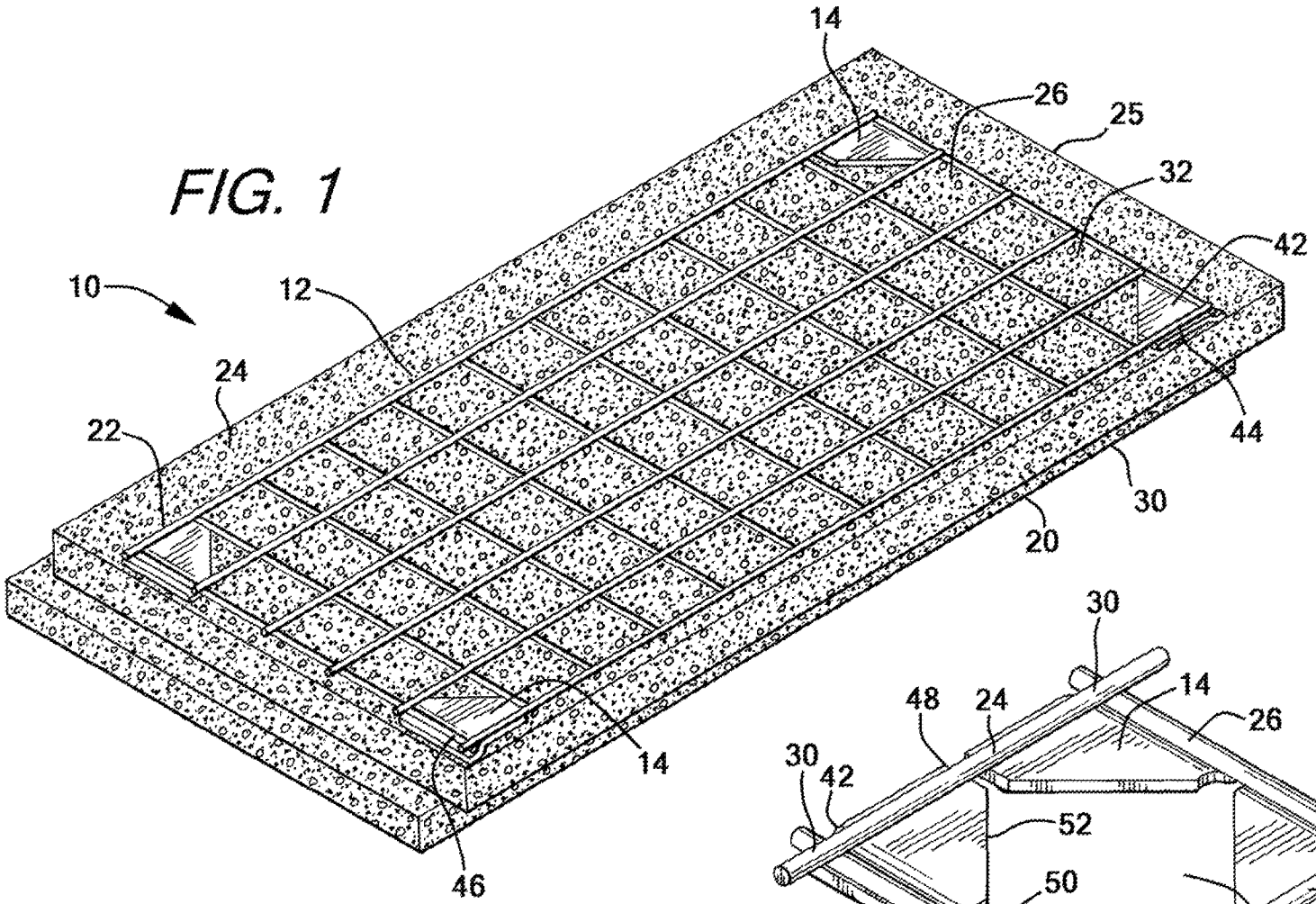
FIG. 1 is a perspective view of a panel showing an embedded web of material supporting hardware for connecting the panel to external structures.

FIG. 1 shows an autoclave aerated concrete panel 10 with an embedded web of material 12 supporting hardware 14 for connecting the panel to an exterior structure. The panel is generally rectangular having a length dimension substantially greater than a width dimension and a depth dimension and can be used for walls, floors, ceilings, and roofs, for example. The panel has opposed planar or facing surfaces 20. The panel could be of other shapes such as polygonal, circular, oval and irregular.

The shape of the web of material preferably generally conforms to the shape and size of the panel and is fully contained within the area defined by the panel and should span an area of from 60-99% of the panel surface area. Thus, if the panel is rectangular the web of material should be rectangular and have lateral edges and ends aligned with those of the panel. If the panel is circular the web of material should be circular and coaxially disposed therewith. It is also desirable, but not necessary, for the web of material to be positioned centrally in the depth dimension and to define a plane that is parallel to one or both planar surfaces of the AAC panel 12.

The embedded material is of a material other than AAC. Suitable materials for the web of material include metals, composites, fiberglass, fabric, synthetic fiber fabric, and plastics for example. The web of material 12 shown in FIG. 1 is a mesh material having a plurality of wires or rebar elements (the terms "wire" and "rebar" will be used interchangeably herein) 22 running parallel to lateral edges 24 of the panel along the length dimension of the panel and a plurality of wires 26 extending perpendicular to the lateral edges 24 along the width dimension of the panel and connecting to a portion of the plurality of wires 22 at points of intersection 30.

While the web of material shown is a mesh material forming square or rectangular windows 32, it could take on other forms. The rebar elements do not necessarily have to intersect with other rebar elements and if they intersect they do not have to be connected to one another. Thus, the term "mesh" is meant to include a plurality of rebar elements extending along any direction including a plurality of rebar elements extending in parallel spaced relationship with no points of intersection. The term "mesh" also includes a first and second plurality of rebar elements intersecting at 900 as shown or at other angles.

The term "mesh" also includes material formed from more than two plurality of rebar elements with more than two points of intersection to form windows having shapes other than rectangular or square and can include one or a combination of two or more of the following, for example, triangular, parallelogram, rhombohedral, diamond, pyramidal, trapezoidal, kite or other shape. Additionally, more than one web of material can be used positioned adjacent one another, adjacent one another and coplanar, or stacked on top of one another, or spaced from one another and not in contact with one another.

The hardware 14 for connecting to the panel 10 to exterior surfaces is shown as a generally triangular shaped plate 14 which is attached to the mesh material by welding, crimping, fasteners or other technique well known to those skilled in the art. FIG. 1 shows the plate 14 spanning across a portion of a window 32 and connected to all four of the wires forming the window 32 and to three of the four points of intersection 30 of the window. The plate has two legs 40,42 joined at proximal ends at an apex 46. End edges 48 and 50 extend perpendicularly from a distal end of the legs, 40,42, respectively, and a hypotenuse edge 52 connects the end edges 48 and 50. In one preferred plate, the legs 40,42 connect to a planar surface 54 of the plate through a step 56 which tapers upward moving from outside to inside. Thus the legs 40,42 can be connected to a bottom surface of the wire and the planar surface 54 can extend to a level even with or above the wire and above the plane formed by the mesh. FIG. 1 shows using four plates similarly situated positioned at terminal corners of the mesh material. While four plates are shown, it is contemplated using a single plate located at any desired location on the mesh or any number of plates located at any desired locations on the mesh. The plates 14 can be a shape other than triangular such as polygonal, round, oval, and irregular. The plates 14 can also span a portion of a window 32 as shown or an entire window or multiple windows.

Figure 2:
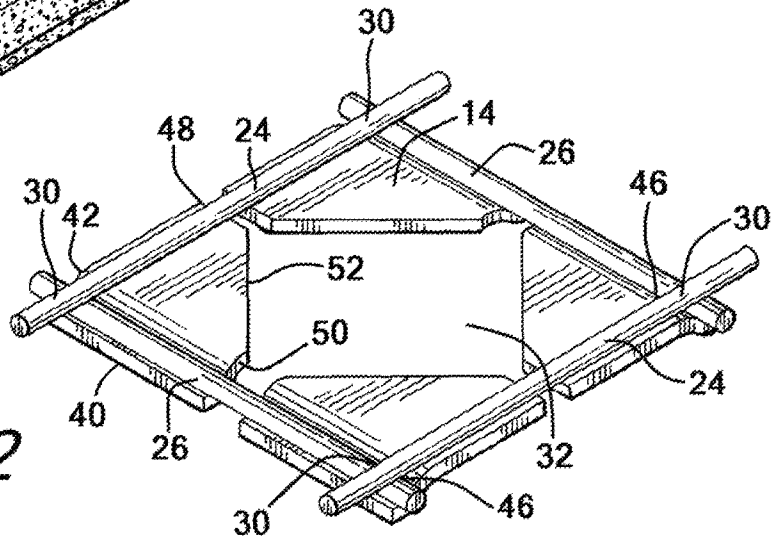
FIG. 2 is a plan view of hardware attached to a web of material.

While one plate 14 is shown associated with a single window, FIG. 2 shows four plates 14 associated with a single window 32. Each plate is connected to two wires of a window 32 instead of all four as shown in FIG. 1. It is contemplated the plate could be connected to, from one to four wires, of a single square or rectangular window or to numerous wires spanning numerous windows. As the mesh includes forms that have no windows or have varying shaped windows, generally speaking, the plate can be attached to any number of wires so long as it can function in its roll to facilitate attachment to structures external to the AAC element.

The mesh and the supporting hardware can be supplied in pre-cut sizes to fit the size and shape of the panel or be stored in rolls and cut to the desired size and shape from the roll.

Figure 3:
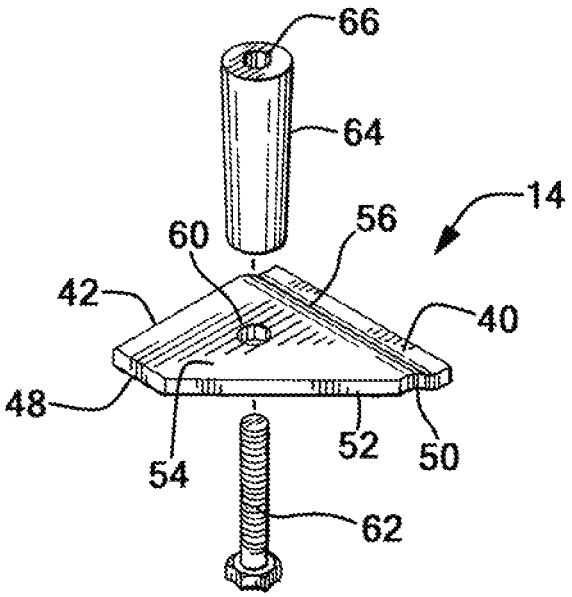
FIG. 3 is an exploded view of hardware.

FIG. 3 shows the plate 14 with a through hole 60 centrally disposed and a threaded bolt or rod 62 for inserting through the hole 60 and into a cylindrical sleeve 64 defining a centrally disposed lumen 66 connecting openings at opposed ends to receive the bolt at one end and external hardware from an opposed end. The cylindrical sleeve will have a height dimension roughly equal to the depth dimension of the AAC panel so that the opening 66 is accessible from a location external from the panel.

Figure 4:
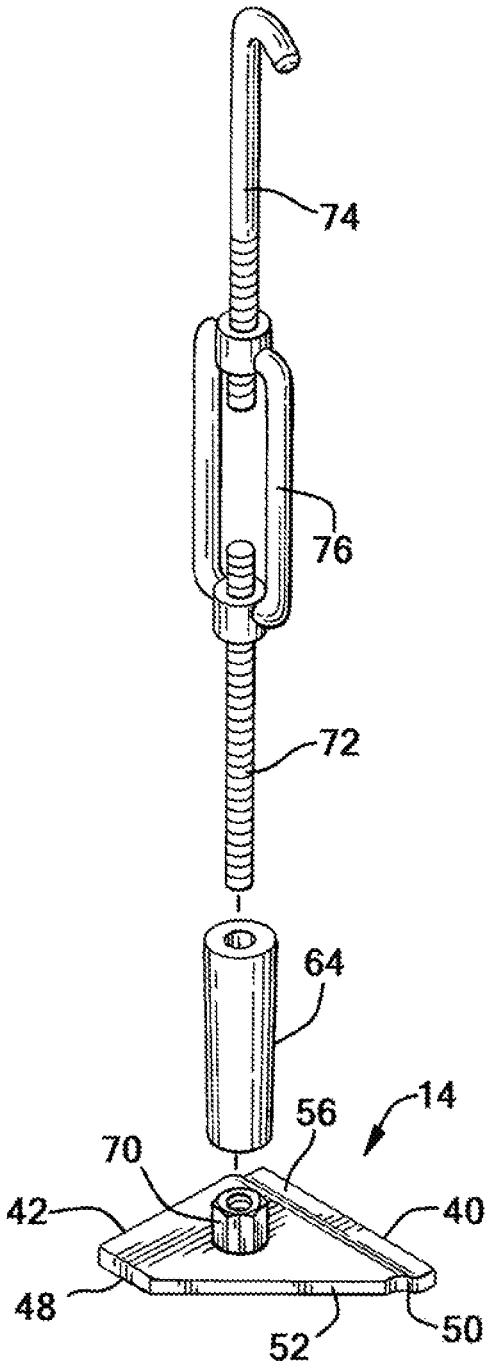
FIG. 4 is an exploded view of hardware.

FIG. 4 shows a different set of hardware including a nut 70 attached to the plate and the lumen of the sleeve 64 concentrically disposed to the nut to allow a threaded rod 72 external to the panel to connect to the nut with mating threads. The rod 72 is shown connected to a hanger bar 74 through a turnbuckle 76. This hardware allows for mounting the panel to an external structure and using the turnbuckle 76 to adjust distances between the panel and the structure and to level the panel. This hardware assembly is useful for forming ceilings, floors and walls.

Figure 5:
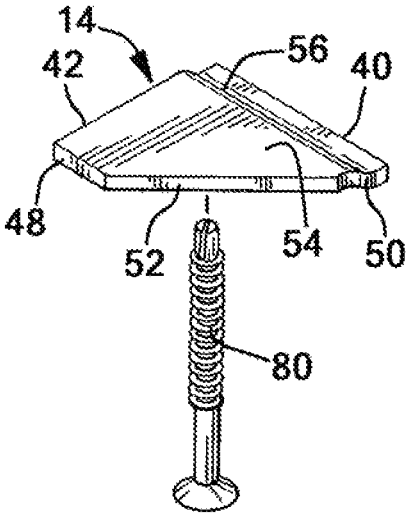
FIG. 5 is an exploded view of hardware.

FIG. 5 shows a screw 80 for attaching to the panel 14 from a location external to the panel. The screw can be of a type that can be driven through one or both planar surfaces of the AAC panel and into the plate 14. An exterior surface of the AAC panel can bear indicia indicating the location of the embedded hardware. It is also possible for the plate to be located using electronic devices such as stud finders, metal detectors or other device.

Figure 6:
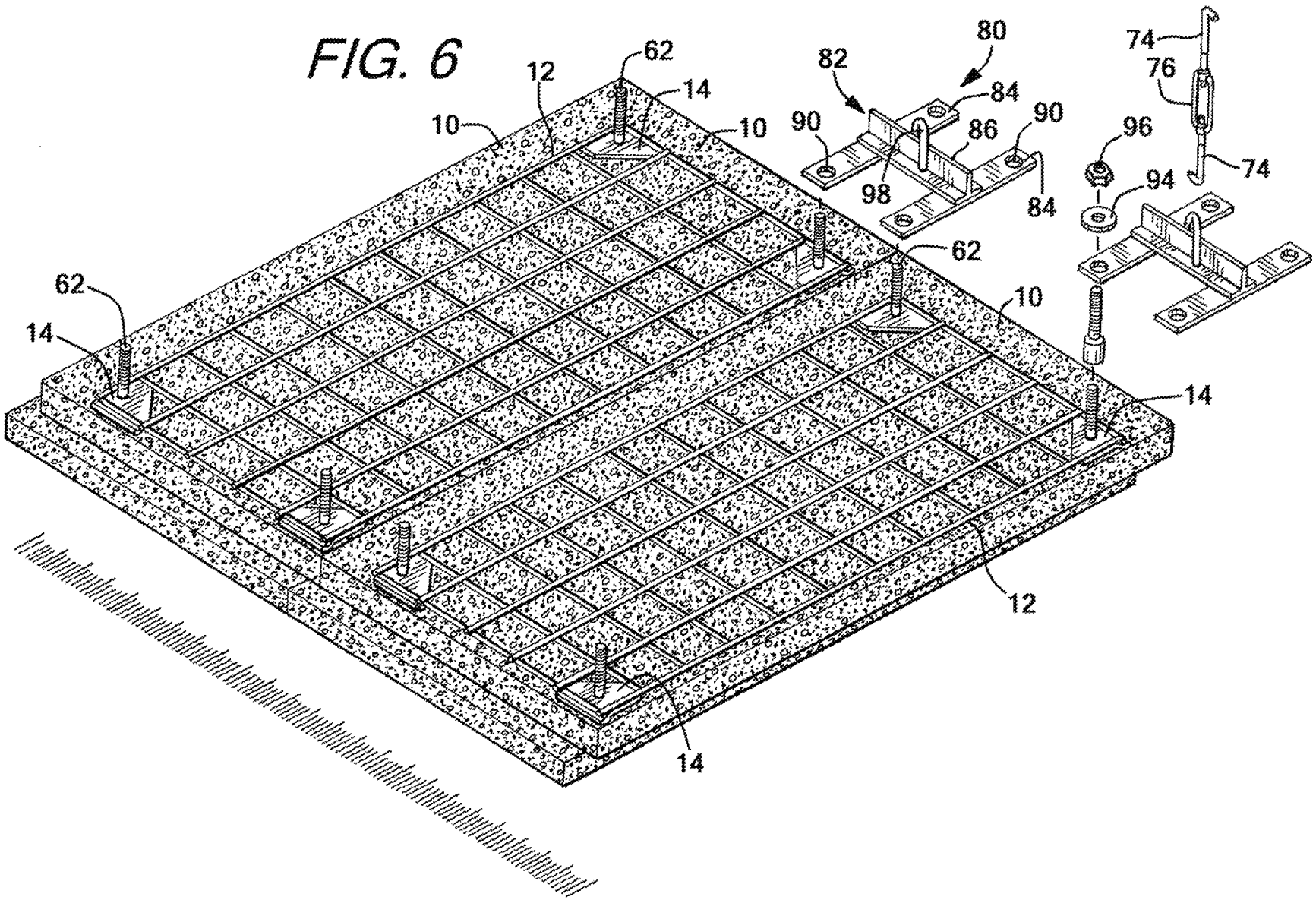
FIG. 6 is a perspective view of hardware for joining two AAC panels.

FIG. 6 shows hardware for attaching AAC panels together at corners. FIG. 6 shows two of the panels 10 being coplanar and abutting one another along lateral edges and extending in parallel spaced relationship. A bracket 82 having two flanges 84 each having opposed ends and are joined together with across bar 86 intermediate the opposed ends. The flanges have through holes 90 for mounting over the threaded rod 62 with an intermediate connecting rod 92 that has threads to mate with those of the threaded rod 62. The connecting rod 92 has a threaded end that extends through the through hole 90 and is fastened thereto with a washer and nut 94,96. The cross bar has a loop 98 for receiving a hanger 74 having a hooked end. Using this hardware, numerous panels can be joined together and moved into position to be joined to an external structure 100 as shown in FIG. 7.

Figures 7, 8:
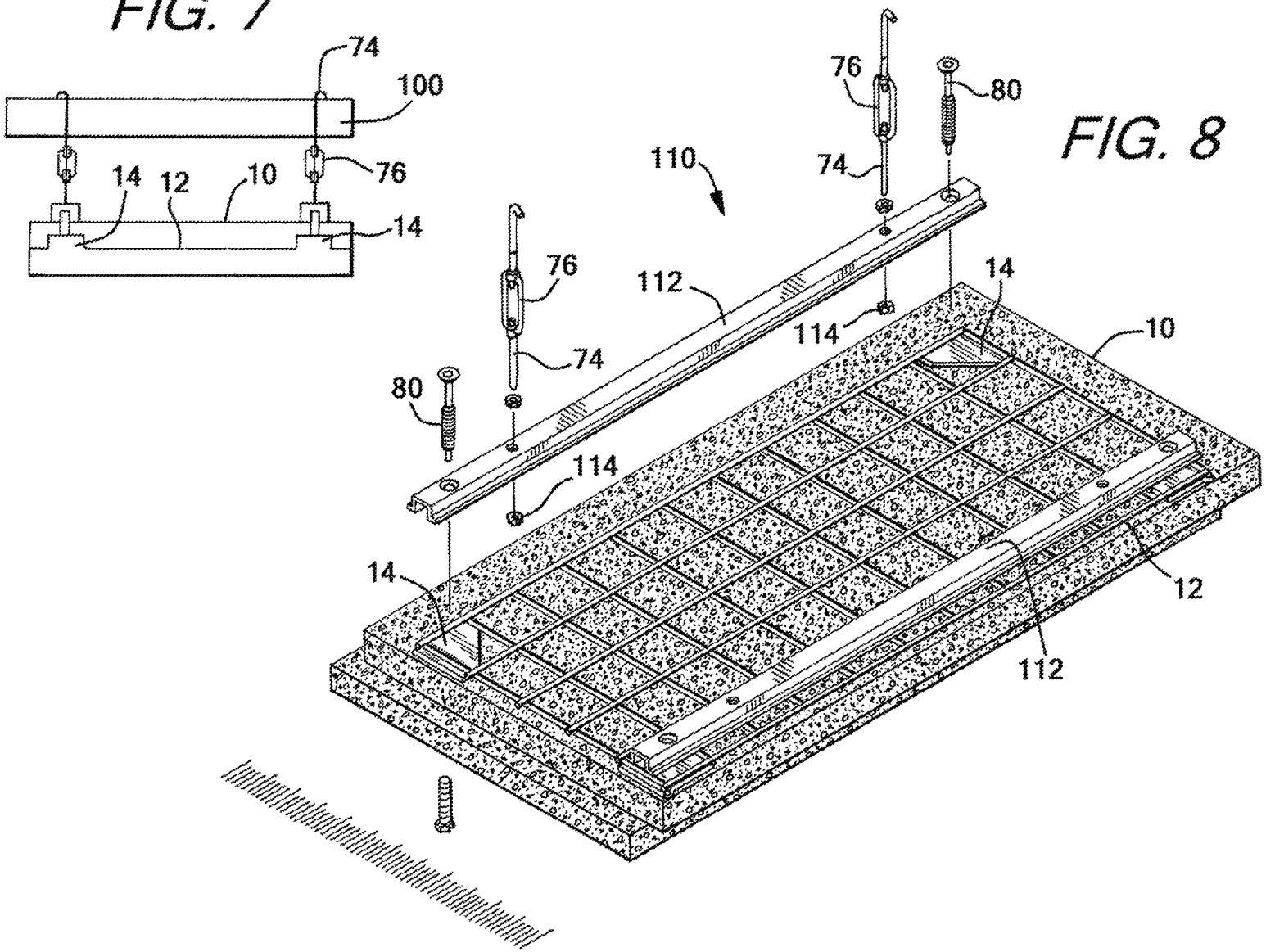
FIG. 7 is a side elevation view of an AAC panel connected to an external structure.
FIG. 8 is a perspective view of an AAC panel and hardware.

FIG. 8 shows a hardware system 110 for attaching mounting brackets 112 along lateral edges of a panel 10 and extending essentially the entire length dimension of the web of material 12. A pair of turnbuckle-type hangers 76 connect to the bracket using nuts 114 that have threads for mating with those of the threaded rod 74. Screws 80 secure the mounting brackets to the plates 14 to form a panel assembly for hanging to an external structure such as shown in FIG. 7.

Figure 9:
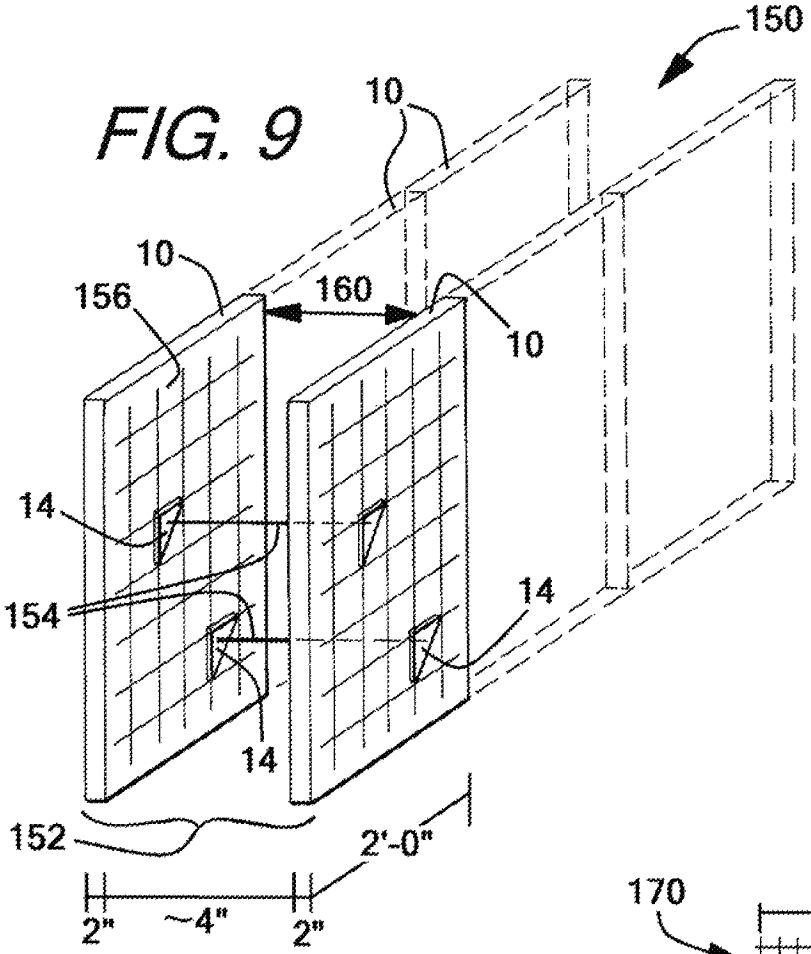
FIG. 9 is a perspective view of a wall system created from joining AAC panels in face-to-face relationship to create a panel set.

FIG. 9 shows a wall structure 150 formed from a plurality of two-panel sets 152 each having two mesh-reinforced AAC panels 10 connected together by a pair of rods 154 extending transversely to a planar surface 156 of each of the panels 10 and connected to embedded plates 14 as described above. The two-panel sets 152 can be used as structural elements to support loads. While two rods 154 are shown connected the facing panels 10 it should be understood that any number of rods suitable for the purpose of connecting the panels together in a permanent fashion can be used. Other suitable hardware could also be used without departing from the scope of the present invention. A gap 160 is provided between the panels to provide space for running equipment relating to mechanical, plumbing, insulation, etc.

Figure 10:
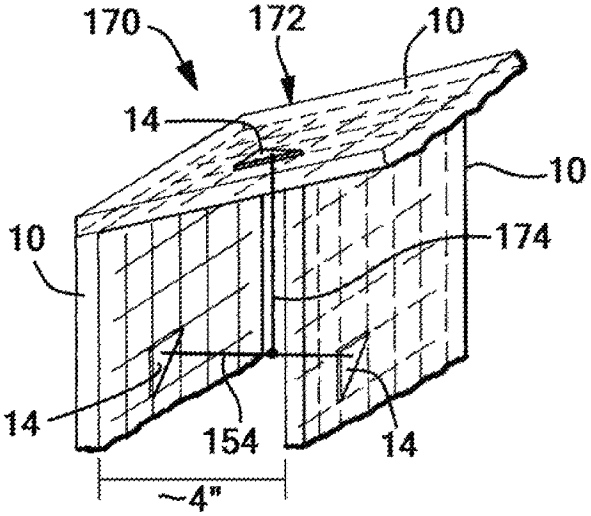
FIG. 10 is a side elevation view of roof system with panel sets forming upstanding walls and roof panels.
Figure 11:
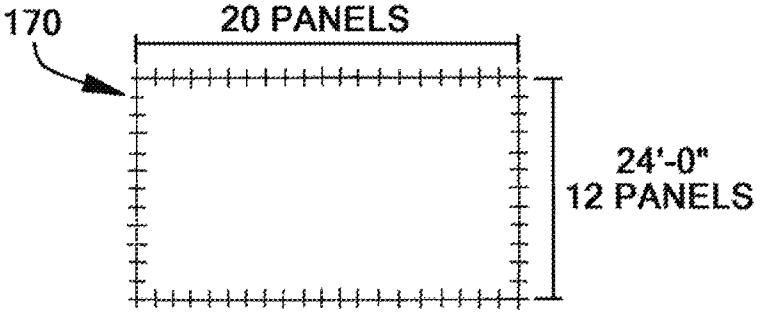
FIG. 11 is a plan view of the roof system shown in FIG. 10.

FIGS. 10 and 11 shows a wall and roof structure formed from a plurality of three-panel sets 170 which adds an AAC panel top panel 172 to the two-panel set 152 described above. The top panel 172 has a vertical rod 174 connected at one end to a plate 14 inside the top panel 172 to an intermediate portion of the horizontal rod 154 connecting the two panels. Any suitable hardware can be provided for this purpose. FIG. 11 shows a plan view of a roof system having an array of two sets of 20 panels by two sets of 12 panels.

Figure 12:
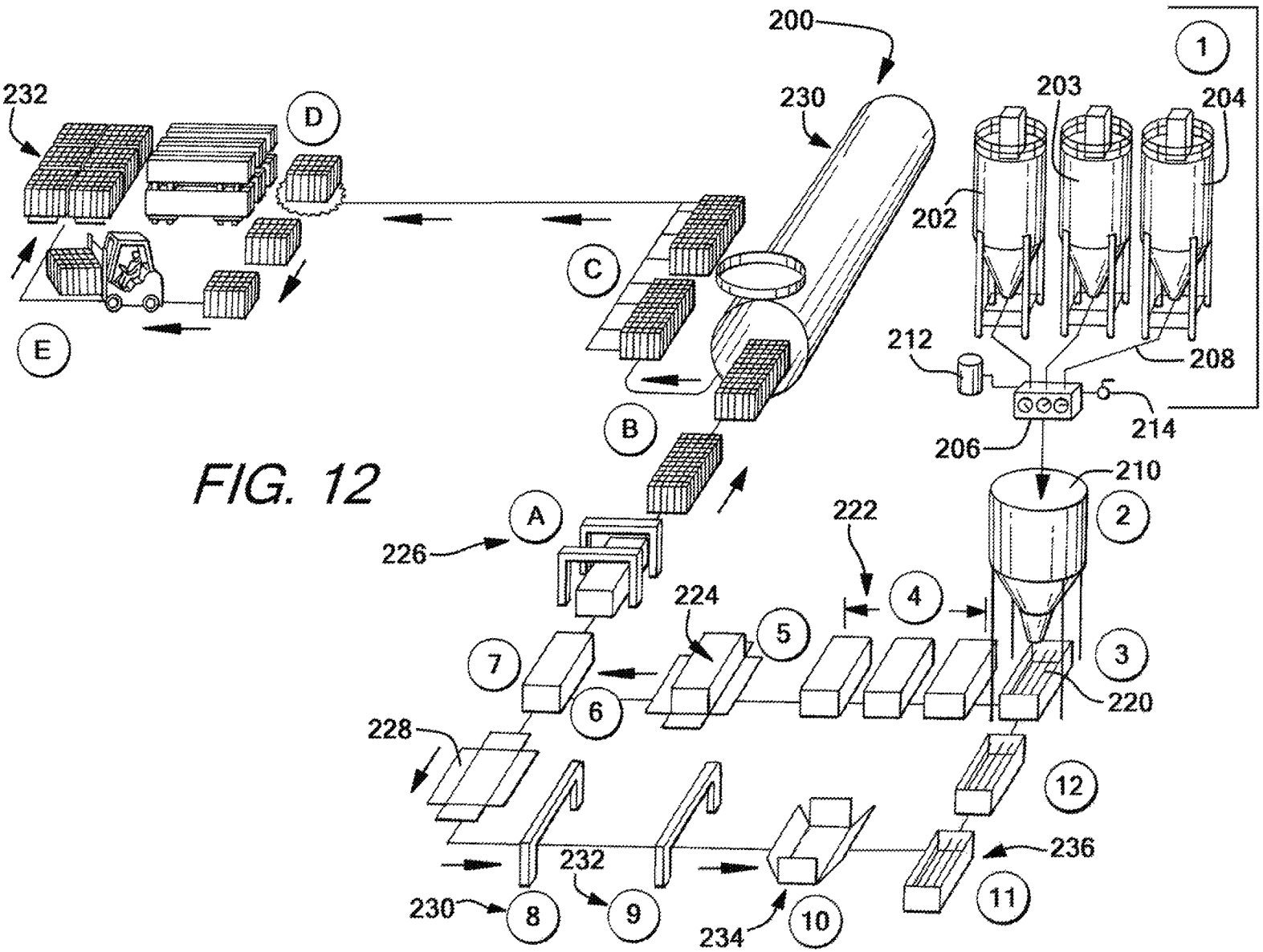
FIG. 12 is a diagrammatic view of a process for forming AAC panels with an embedded web of material supporting hardware for connecting the AAC panel to external structures.

FIG. 12 shows a diagrammatic view of a process 200 for manufacturing an AAC panel with an embedded hardware for connecting to an external structure. The components for forming AAC are separately stored in silo structures 202 for silica from sand or fly ash, cement 203, and lime 204. The silos are connected to a metering valve 206 through pipes 208 which controls the quantity of each component into a mixer 210. An expansion agent is stored in a container 212 and water is supplied from a source 214 to the metering valve 206. The quantity of the components is well known to a person of ordinary skill in the art. When the components are mixed they are poured into a mold 220 containing the webs of material and associated hardware and the components expand into the mold with the webs of material embedded therein and spaced from one another. Molds can vary in size but anywhere from 1 to 4 panels, for example, can be formed in a single mold. The filled mold is conveyed away from the mixer in a pre-curing stage 222.

In step 224, the mold is collapsed and the pre-cured cake, or green cake, is removed from the mold and conveyed to a cutting station 226 where the cake is cut into separate panels with the web of material and associated hardware embedded therein. The collapsed mold is cleaned 230, oiled 232, closed 234, and the webs of material and associated hardware are inserted into the mold 236 and returned to the a location under the mixer 210.

The green block is conveyed from the cutting station 226 into an autoclave 230 for an effective period of time to cure the green panels into AAC panels. The AAC panels are packaged for shipping at station 232.

While specific embodiments have been illustrated and described, numerous modifications come to mind without departing from the spirit of the invention and the scope of protection is only limited by the scope of the accompanying claims.

What is claimed is:

1. An element of an autoclave aerated concrete (AAC) material, the element comprising:

a mesh material having a first plurality of rebar elements extending parallel to one another in a first direction, and a second plurality of rebar elements extending parallel to one another in a second direction and intersecting with the first plurality of rebar elements to define a plurality of windows, a plate positioned within a window of the plurality of windows such that it is directly connected to at least one rebar element of the first plurality of rebar elements and at least one rebar element of the second plurality of rebar elements, the plate having a planar surface parallel to the first plurality of rebar elements, and supporting hardware attached to the plate and for connecting the element to other structures.

2. The element of claim 1 wherein the supporting hardware extends from the plate and comprises at least one of a threaded rod, a threaded hanger bar, and a bolt and at least one of a nut and a turnbuckle.

3. The element of claim 1 further comprising an upper surface having indicia of a location of the supporting hardware.

4. The element of claim 3 wherein the element is a panel having a generally polygonal shape.

5. The element of claim 4 wherein the generally polygonal shape is rectangular.

6. The element of claim 5 wherein the mesh is generally centrally disposed in the depth dimension of the element.

7. The element of claim 6 wherein the mesh defines a plane generally parallel to the upper surface.

8. The element of claim 6 further comprising a bracket attached to the plate via the supporting hardware.

9. The element of claim 8 further comprising a plurality of plates, each positioned within a window of the plurality of window, wherein the bracket attaches to at least two of the plurality of plates.

10. The element of claim 8 wherein the bracket has a through hole for receiving an attachment member through a planar surface.

11. The element of claim 8 wherein the bracket has a threaded nut for receiving an attachment member through a planar surface.

12. The element of claim 8 further comprising a sleeve extending from the bracket and having an opening through a planar surface.

13. The element of claim 8 further comprising a threaded rod extending from the bracket through a planar surface.

* * * * *